US010701762B2

(12) United States Patent
Kondo

(10) Patent No.: US 10,701,762 B2
(45) Date of Patent: Jun. 30, 2020

(54) HEAT RADIATION DEVICE, AND PROCESSING DEVICE USING HEAT RADIATION DEVICE

(71) Applicant: NGK INSULATORS, LTD., Nagoya-Shi (JP)

(72) Inventor: Yoshio Kondo, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 98 days.

(21) Appl. No.: 16/136,542

(22) Filed: Sep. 20, 2018

(65) Prior Publication Data

US 2019/0021139 A1 Jan. 17, 2019

Related U.S. Application Data

(63) Continuation of application No. PCT/JP2017/010019, filed on Mar. 13, 2017.

(30) Foreign Application Priority Data

Mar. 24, 2016 (JP) ..... 2016-060652

(51) Int. Cl.
*H05B 3/12* (2006.01)
*H05B 3/28* (2006.01)
(Continued)

(52) U.S. Cl.
CPC ..... *H05B 3/12* (2013.01); *F26B 3/30* (2013.01); *F26B 15/12* (2013.01); *H05B 1/02* (2013.01);
(Continued)

(58) Field of Classification Search
CPC ... F26B 3/30; F26B 15/12; H05B 3/12; H05B 1/02; H05B 3/265; H05B 3/283;
(Continued)

(56) References Cited

U.S. PATENT DOCUMENTS 6,768,126 B2 * 7/2004 Novak ..... H05B 3/28 250/345
7,132,625 B2 * 11/2006 Voeltzel ..... B32B 17/10036 219/203
(Continued)

FOREIGN PATENT DOCUMENTS

EP 2634817 A4 * 6/2017 ..... H01L 35/00
EP 3435735 A4 * 10/2019 ..... H05B 3/283
(Continued)

OTHER PUBLICATIONS

International Search Report and Written Opinion (Application No. PCT/JP2017/010019) dated Apr. 4, 2017.
(Continued)

*Primary Examiner* — Stephen M Gravini
(74) *Attorney, Agent, or Firm* — Burr & Brown, PLLC

(57) ABSTRACT

A heat radiation device includes a heat source, a meta-material structure layer arranged on a front surface side of the heat source and configured to radiate radiant energy in a specific wavelength range by converting heat energy inputted from the heat source into the radiant energy in the specific wavelength range, and a rear-surface metal layer arranged on a rear surface side of the heat source. An average emissivity of the rear-surface metal layer is smaller than an average emissivity of the meta-material structure layer.

7 Claims, 5 Drawing Sheets

(51) Int. Cl.

| | |
|---|---|
| ***H05B 3/26*** | (2006.01) |
| ***F26B 15/12*** | (2006.01) |
| ***H05B 3/66*** | (2006.01) |
| ***F26B 3/30*** | (2006.01) |
| ***H05B 1/02*** | (2006.01) |
| ***H05B 3/30*** | (2006.01) |

(52) U.S. Cl.
CPC ..... *H05B 3/265* (2013.01); *H05B 3/283* (2013.01); *H05B 3/30* (2013.01); *H05B 3/66* (2013.01); *H05B 2203/013* (2013.01); *H05B 2203/032* (2013.01)

(58) Field of Classification Search
CPC ..... H05B 3/30; H05B 3/66; H05B 2203/013; H05B 2203/032
USPC ..... 34/266
See application file for complete search history.

(56) References Cited

U.S. PATENT DOCUMENTS

| | | | | |
|---|---|---|---|---|
| 7,485,352 | B2 * | 2/2009 | Yuasa | F16L 59/065 428/34.1 |
| 9,105,368 | B2 * | 8/2015 | Nagatani | G01J 3/108 |
| 9,467,088 | B2 * | 10/2016 | Matsumoto | H01L 35/00 |
| 9,981,633 | B2 * | 5/2018 | Lisinski | B32B 17/10174 |
| 10,536,994 | B2 * | 1/2020 | Guillaume | B32B 17/10036 |
| 2002/0195445 | A1 | 12/2002 | Sako et al. | |
| 2011/0020565 | A1 * | 1/2011 | Yasuda | F26B 3/283 427/557 |
| 2011/0056928 | A1 | 3/2011 | Feng et al. | |
| 2014/0263278 | A1 * | 9/2014 | Zakhidov | H05B 3/10 219/472 |
| 2018/0244242 | A1 * | 8/2018 | Lisinski | B32B 17/10174 |
| 2019/0021139 | A1 * | 1/2019 | Kondo | H05B 3/283 |

FOREIGN PATENT DOCUMENTS

| | | | | |
|---|---|---|---|---|
| JP | H03-131027 | A1 | 6/1991 | |
| JP | 2009243749 | A * | 10/2009 | F26B 3/283 |
| JP | 2013-206606 | A1 | 10/2013 | |
| JP | WO2012056806 | A1 * | 3/2014 | H01L 31/0236 |
| JP | 2015-198063 | A1 | 11/2015 | |
| JP | WO2017163986 | A1 * | 1/2019 | H05B 3/66 |
| WO | WO-2009122883 | A1 * | 10/2009 | F26B 3/283 |
| WO | WO-2012056806 | A1 * | 5/2012 | H01L 31/0547 |
| WO | 2014/168229 | A1 | 10/2014 | |
| WO | WO-2017163986 | A1 * | 9/2017 | F26B 15/12 |

OTHER PUBLICATIONS

Extended European Search Report (Application No. 17770029.1) dated Sep. 18, 2019.

* cited by examiner

HEAT RADIATION DEVICE, AND PROCESSING DEVICE USING HEAT RADIATION DEVICE

TECHNICAL FIELD

The technique disclosed herein relates to a heat radiation device configured to radiate radiant energy of a specific wavelength by using a meta-material structure layer.

BACKGROUND ART

JP 2015-198063 A describes an infrared heater using a meta-material structure layer (an example of a heat radiation device). This infrared heater is provided with a heating element and a microcavity component (an example of a meta-material structure layer) arranged on a front surface side of the heating element. Heat energy outputted from the heating element is radiated as radiant energy of a specific wavelength by being transferred through the microcavity component.

SUMMARY

Technical Problem

As aforementioned, in a heat radiation device using a meta-material structure, heat energy outputted from a heat source can be radiated as radiant energy of a specific wavelength from a surface on a meta-material structure layer side. However, in a conventional heat radiation device, a quantity of heat energy emitted from surfaces other than the surface on the meta-material structure layer side is large, and there had been a problem that a large heat energy loss thereby occurs. The description herein provides a heat radiation device capable of suppressing a heat energy loss as compared to the conventional heat radiation device.

Solution to Technical Problem

A heat radiation device disclosed in the disclosure comprises: a heat source; a meta-material structure layer arranged on a front surface side of the heat source and configured to radiate radiant energy in a specific wavelength range by converting heat energy inputted from the heat source into the radiant energy in the specific wavelength range; and a rear-surface metal layer arranged on a rear surface side of the heat source, wherein an average emissivity of the rear-surface metal layer is smaller than an average emissivity of the meta-material structure layer.

In the above heat radiation device, the heat source is arranged between the meta-material structure layer and the rear-surface metal layer. Further, the emissivity of the rear-surface metal layer is smaller than the emissivity of the meta-material structure layer. Due to this, a heat energy loss from the rear-surface metal layer is suppressed small, and the heat energy loss can be suppressed as compared to a conventional heat radiation device.

Here, the "average emissivity" as above means an average emissivity over an entire infrared wavelength range (0.7 μm to 1 mm). Thus, "an average emissivity of the rear-surface metal layer is smaller than an average emissivity of the meta-material structure layer" as above stands true even if the emissivity of the rear-surface metal layer is larger in a part of the wavelength range, so long as the average emissivity of the rear-surface metal layer is smaller than the average emissivity of the meta-material structure layer in the entire infrared wavelength range.

Further, the "average emissivity" as above means an "average emissivity" measured upon when the rear-surface metal layer and the meta-material structure layer are set to a same setting temperature. Due to this, in a case where a temperature of the rear-surface metal layer and a temperature of the meta-material structure layer differ upon operating the heat radiation device, the "average emissivity" is measured by bringing the rear-surface metal layer to the setting temperature and the "average emissivity" is measured by bringing the meta-material structure layer to the setting temperature, and a magnitude comparison is performed based on these measured "average emissivity". The "setting temperature" as above may for example be a temperature of the meta-material structure layer or a temperature of the rear-surface metal layer when the heat radiation device is operated at a rated output.

Further, the description herein discloses a novel processing device configured to process a target object using the heat radiation device as above. The processing device disclosed herein comprises the heat radiation device as described above arranged to face the target object; a housing that houses the target object and the heat radiation device; and a holder that holds the heat radiation device in the housing, with one end of the holder attached to an inner wall surface of the housing and another end of the holder attached to a part of the heat radiation device. The meta-material structure layer of the heat radiation device faces the target object. The rear-surface metal layer of the heat radiation device faces the inner wall surface of the housing. A gap is provided between the rear-surface metal layer and the inner wall surface of the housing.

According to the processing device as above, the heat energy loss caused by the radiation from the rear-surface metal layer can be suppressed, and in addition a heat energy loss caused by thermal conduction from the rear-surface metal layer can be suppressed. Due to this, the processing of the target object using the heat radiation device can be performed effectively.

DESCRIPTION OF EMBODIMENTS

Firstly, some features of embodiments described hereinbelow will be listed. Each of the features listed herein exhibits usefulness by being employed individually.

(Feature 1) In a heat radiation device disclosed herein, a meta-material structure layer may be arranged on a front surface of a first support substrate. A rear-surface metal layer may be arranged on a rear surface of a second support substrate. A heat source may be arranged between the first support substrate and the second support substrate. Further, a heat conductivity of the second support substrate may be smaller than a heat conductivity of the first support substrate. According to such a configuration, the heat energy flowing from the heat source to the second support substrate can be suppressed low, and a heat energy loss from the rear-surface metal layer can suitably be suppressed.

(Feature 2) In the heat radiation device disclosed herein, the first support substrate may be an AlN substrate. The second support substrate may be an $Al_2O_3$ substrate. The rear-surface metal layer may be an Au layer. According to such a configuration, a heat loss from the Au layer being the rear-surface metal layer can suitably be suppressed.

(Feature 3) In the heat radiation device disclosed herein, a thickness of the first support substrate may be smaller than a thickness of the second support substrate. According to such a configuration, heat from the heat source flows easily to the first support substrate being a substrate on a meta-material structure layer side, by which the heat energy from the heat source can more effectively be utilized.

(Feature 4) In a processing device using the heat radiation device disclosed herein, a partition wall partitioning a space in a housing into a first space in which a target object is housed and a second space in which the heat radiation device is housed may further be comprised. The partition wall may allow radiant energy in a specific wavelength range to pass therethrough. According to such a configuration, a temperature rise in the target object can suitably be suppressed. On the other hand, a process to radiate the radiant energy of a specific wavelength range on the target object can be performed.

(Feature 5) In the processing device using the heat radiation device disclosed herein, a drying process may be executed on the target object in the housing.

Embodiments

Figure 1:
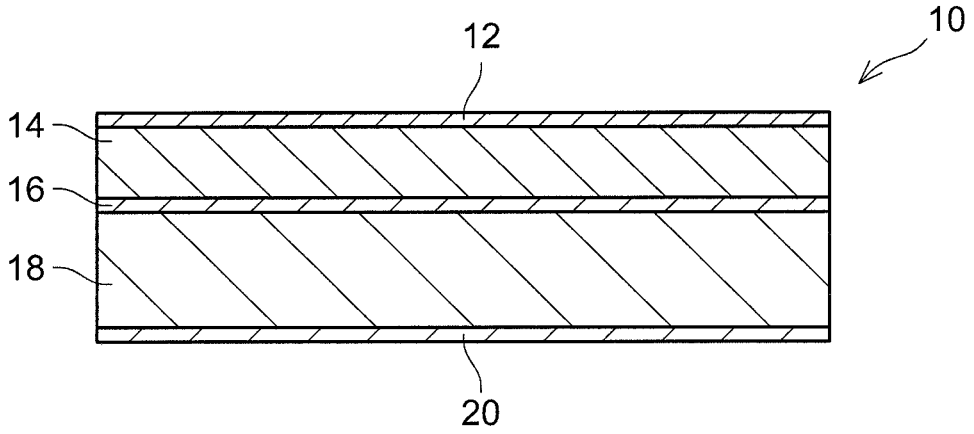
FIG. 1 is a vertical cross-sectional view of a heat radiation device of a present embodiment.

The heat radiation device 10 of the present embodiment is a heat radiation device (emitter) configured to radiate radiant energy in a specific wavelength range in an entire infrared wavelength range (0.7 μm to 1 mm). As shown in FIG. 1, the heat radiation device 10 includes a laminate structure in which a plurality of layers is laminated, and includes a heat generating layer 16 (which is an example of a heat source), a first support substrate 14 arranged on a front surface side of the heat generating layer 16, a MIM structure layer 12 arranged on a front surface side of the first support substrate 14, a second support substrate 18 arranged on a rear surface side of the heat generating layer 16, and a rear-surface metal layer 20 arranged on a rear surface side of the second support substrate 18.

The heat generating layer 16 is a layer that converts inputted electric energy to heat energy. As the heat generating layer 16, various types of known heat generating layers may be used, and for example, a layer formed by pattern-printing a heat generating wire (conductive material) on a front surface of the second support substrate 18, or a carbon sheet heater may be used. The heat generating layer 16 is connected to an external power source (not shown), and the electric energy is supplied from the external power source. A heat energy quantity generated in the heat generating layer 16 is controlled by an electric energy quantity supplied from the external power source being controlled. The heat generating layer 16 is arranged between the first support substrate 14 and the second support substrate 18, so the heat energy generated in the heat generating layer 16 flows to a first support substrate 14 side and a second support substrate 18 side.

The first support substrate 14 is in contact with a front surface of the heat generating layer 16. The first support substrate 14 may be constituted of a material with a large heat conductivity, and for example, an aluminum nitride (AlN) substrate or a silicon carbide (SiC) substrate may be used. The first support substrate 14 and the heat generating layer 16 may be adhered by using adhesive, or may be bonded by applying pressure therebetween by using a casing or the like (by so-called pressure welding).

The MIM (Metal-Insulator-Metal) structure layer 12 is one type of a meta-material structure layer, and is provided on a front surface of the first support substrate 14. The MIM structure layer 12 radiates the heat energy inputted from the heat generating layer 16 as radiant energy from a front surface thereof. That is, the MIM structure layer 12 is configured to radiate the radiant energy of a peak wavelength and in a narrow wavelength range (specific wavelength range) surrounding the peak wavelength, but configured not to radiate the radiant energy in ranges other than the specific wavelength range. That is, the MIM structure layer 12 has a high emissivity (such as 0.85 to 0.9) at the peak wavelength and an extremely low emissivity (such as 0.1 or lower) in the wavelength ranges other than the specific wavelength range. Due to this, an average emissivity of the MIM structure layer 12 in the entire infrared wavelength range (0.7 μm to 1 mm) is 0.15 to 0.3. As the specific wavelength range, for example, it may have its peak wavelength (such as 5 to 7 μm) in a near-infrared wavelength range (such as 2 to 10 μm), and may have its half power width adjusted to be about 1 μm.

Figure 2:
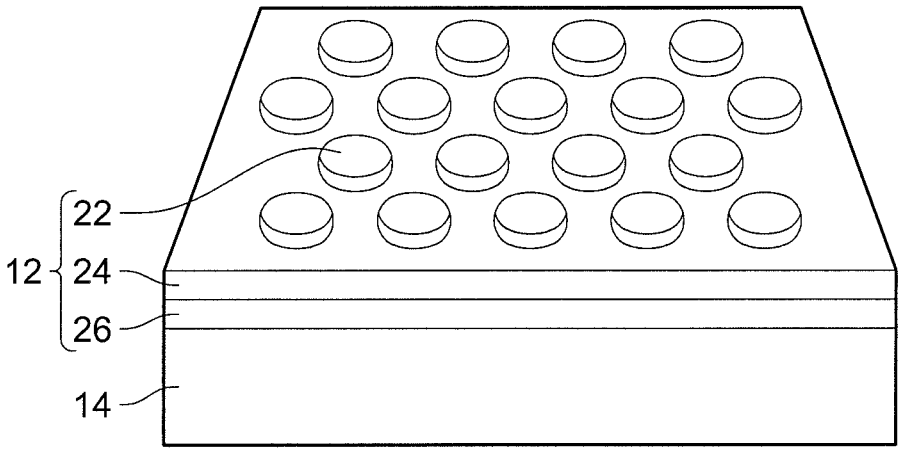
FIG. 2 is an enlarged view of a primary portion that schematically shows a structure of a MIM structure layer.

As shown in FIG. 2, the MIM structure layer 12 includes a first metal layer 26 provided on the front surface of the first support substrate 14, an insulation layer 24 provided on a front surface of the first metal layer 26, and a plurality of protruding metal portions 22 provided on a front surface of the insulation layer 24. The first metal layer 26 may be constituted of metal such as gold (Au), aluminum (Al), and molybdenum (Mo), and in this embodiment, it is constituted of gold (Au). The first metal layer 26 is provided over an entirety of the front surface of the first support substrate 14. The insulation layer 24 may be constituted of an insulation material such as ceramic, and in this embodiment, it is constituted of aluminum oxide ($Al_2O_3$). The insulation layer 24 is provided over an entirety of the front surface of the first metal layer 26. The protruding metal portions 22 is given a round columnar shape by metal such as gold (Au), aluminum (Al), and molybdenum (Mo), and in this embodiment, they are constituted of gold (Au). The protruding metal portions 22 are provided at parts of the front surface of the insulation layer 24. The protruding metal portions 22 are arranged in plurality with intervals between each other in an x direction and a y direction on the front surface of the insulation layer 24. The peak wavelength of the radiant energy radiated from the MIM structure layer 12 can be adjusted by adjusting a dimension of the protruding metal portions 22 (diameter and height of the round columnar shape). Further, by adjusting an arrangement pattern of the protruding metal portions 22 (the intervals between the adjacent protruding metal portions 22), a range limits of the aforementioned "specific wavelength range" can be adjusted. The MIM structure layer 12 as aforementioned may be fabricated using a well-known nano-processing technique.

In the heat radiation device 10 of the present embodiment, the MIM structure layer 12 is used, however, a metamaterial structure layer other than the MIM structure layer may be used. For example, a microcavity structure described in JP 2015-198063 A may be provided on the front surface of the first support substrate 14.

The second support substrate 18 is in contact with a rear surface of the heat generating layer 16. The second support substrate 18 may be constituted of a material having a small heat conductivity as compared to the heat conductivity of the first support substrate 14, and for example, an aluminum oxide ($Al_2O_3$) substrate may be used. The second support substrate 18 and the heat generating layer 16 may be adhered by using adhesive, or may be bonded by applying pressure therebetween by using a casing or the like (by so-called pressure welding). As it is apparent from FIG. 1, a thickness of the second support substrate 18 is made larger than a thickness of the first support substrate 14. Thermal resistance of the second support substrate 18 is made larger than thermal resistance of the first support substrate 14 by adjusting the heat conductivities and the thicknesses. Due to this, the heat energy generated in the heat generating layer 16 flows at a larger quantity to the first support substrate 14 side than to the second support substrate 18 side.

The rear-surface metal layer 20 is arranged on a rear surface of the second support substrate 18. The rear-surface metal layer 20 is constituted of a metal material with a low emissivity (such as gold (Au) and aluminum (Al)). In this embodiment, the rear-surface metal layer 20 is constituted of gold (Au). Due to this, an average emissivity of the rear-surface metal layer 20 in the entire infrared wavelength range is about 0.05. Thus, the average emissivity of the rear-surface metal layer 20 is set smaller than the average emissivity of the MIM structure layer 12. The rear-surface metal layer 20 may be fabricated by using sputtering on an entirety of the rear surface of the second support substrate 18.

In order to radiate the radiant energy (infrared beam) in the specific wavelength range from the aforementioned heat radiation device 10, the electric energy is supplied to the heat generating layer 16. Due to this, the heat generating layer 16 converts the electric energy to the heat energy, and the heat energy is transferred from the heat generating layer 16 to the first support substrate 14 or to the second support substrate 18. Here, the first support substrate 14 has the higher heat conductivity and the smaller thickness as compared to the second support substrate 18. Due to this, the heat energy transferred from the heat generating layer 16 to the first support substrate 14 becomes larger than the heat energy transferred from the heat generating layer 16 to the second support substrate 18. Due to this, a temperature of the first support substrate 14 becomes higher than a temperature of the second support substrate 18.

The heat energy transferred to the first support substrate 14 is transferred (inputted) to the MIM structure layer 12. The MIM structure layer 12 radiates the heat energy inputted from the first support substrate 14 as the radiant energy from the front surface thereof. On the other hand, the heat energy transferred to the second support substrate 18 is transferred to the rear-surface metal layer 20, and is radiated from the rear surface of the rear-surface metal layer 20. Here, since the emissivity of the rear-surface metal layer 20 is set low, the quantity of the radiant energy radiated from the rear-surface metal layer 20 is thereby suppressed. Further, as aforementioned, the temperature of the second support substrate 18 is lower than the temperature of the first support substrate 14, by which a temperature of the rear-surface metal layer 20 also becomes low. Due to this as well, the quantity of the radiant energy radiated from the rear-surface metal layer 20 can be suppressed.

Figure 3:
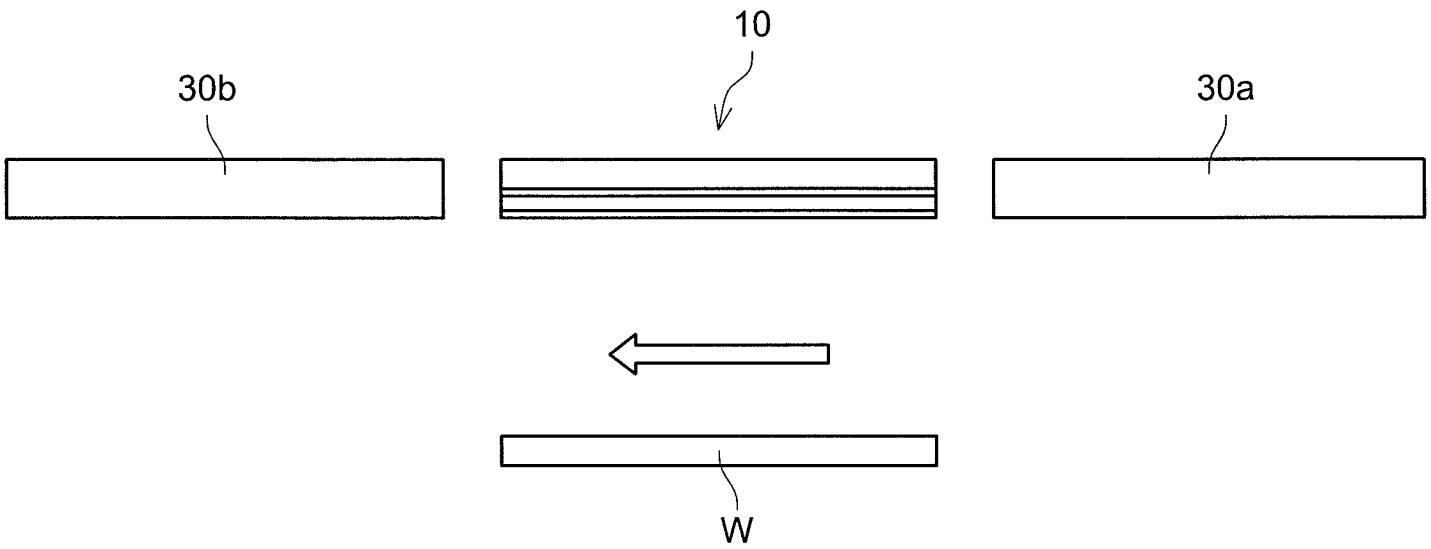
FIG. 3 is a diagram for explaining an example of a heat balance of the heat radiation device according to the embodiment.

Here, a heat balance calculation for a case of heating a workpiece W (which is an example of a target object) using the aforementioned heat radiation device 10 will be described with reference to FIG. 3. As shown in FIG. 3, the heat radiation device 10 is arranged with the MIM structure layer 12 facing downward, and the MIM structure layer 12 faces the workpiece W. Furnace walls 30*a*, 30*b* constituted of SUS are arranged on right and left sides of the heat radiation device 10. Further, air in a furnace flows in a direction of an arrow in upper and lower spaces in the heat radiation device 10. The heat balance calculation was performed under a condition in which the electric energy is supplied to the heat generating layer 16 so that the front surface temperature of the MIM structure layer 12 is set to 280° C. As a result of the calculation, about 20% of the heat energy inputted to the heat generating layer 16 was radiated onto the workpiece W as the radiant energy from the heat radiation device 10, about 20% was used for heating the workpiece W by convective heat transfer from the heat radiation device 10, and about 60% of the remaining became a heat energy loss. The heat energy loss was broken down primarily to a heat loss by heat transfer from the heat radiation device 10 to the furnace walls 30*a*, 30*b* and a heat loss by convection from the rear-surface metal layer 20 of the heat radiation device 10. That is, the heat loss by radiation from the rear-surface metal layer 20 hardly occurred.

Next, a heat balance calculation for a case of heating the workpiece W using a heat radiation device of a comparative example will be described with reference to FIG. 4. The heat radiation device of the comparative example includes the first support substrate 14 and the MIM structure layer 12 similar to the heat radiation device 10, however, it differs in that it uses a ceramic heater 32 instead of the heat generating layer 16, and the second support substrate 18 and the rear-surface metal layer 20 are not arranged on a rear side of the ceramic heater 32 (which is an upper side in FIG. 4). As it is apparent from FIG. 4, the heat radiation device of the comparative example is arranged to face the workpiece W, and furnace walls 34*d*, 34*e* constituted of SUS are arranged on left and right sides thereof. However, insulation members 34*a*, 34*b*, 34*c* are arranged on a rear surface side of the heat radiation device of the comparative example (which is the upper side in FIG. 4), by which heat insulation of the ceramic heater 32 is implemented. Further, to prevent heat transfer from the ceramic heater 32, a space is provided between the ceramic heater 32 and the insulation member 34*a*. A condition of the heat balance calculation was set identical to that of FIG. 3. That is, the calculation was performed under the condition in which electric energy is supplied to the ceramic heater 32 so that the front surface temperature of the MIM structure layer 12 is set to 280° C. As a result of the calculation, about 10% of the heat energy inputted to the ceramic heater 32 was radiated onto the workpiece W as radiant energy, about 10% was used for heating the workpiece W by convective heat transfer, and about 80% of the remaining became a heat energy loss. The heat energy loss was broken down primarily to a heat loss by heat transfer to the furnace walls 34*d*, 34*e* and a heat loss by heat transfer to the insulation members 34*b*, 34*c*.

Figure 4:
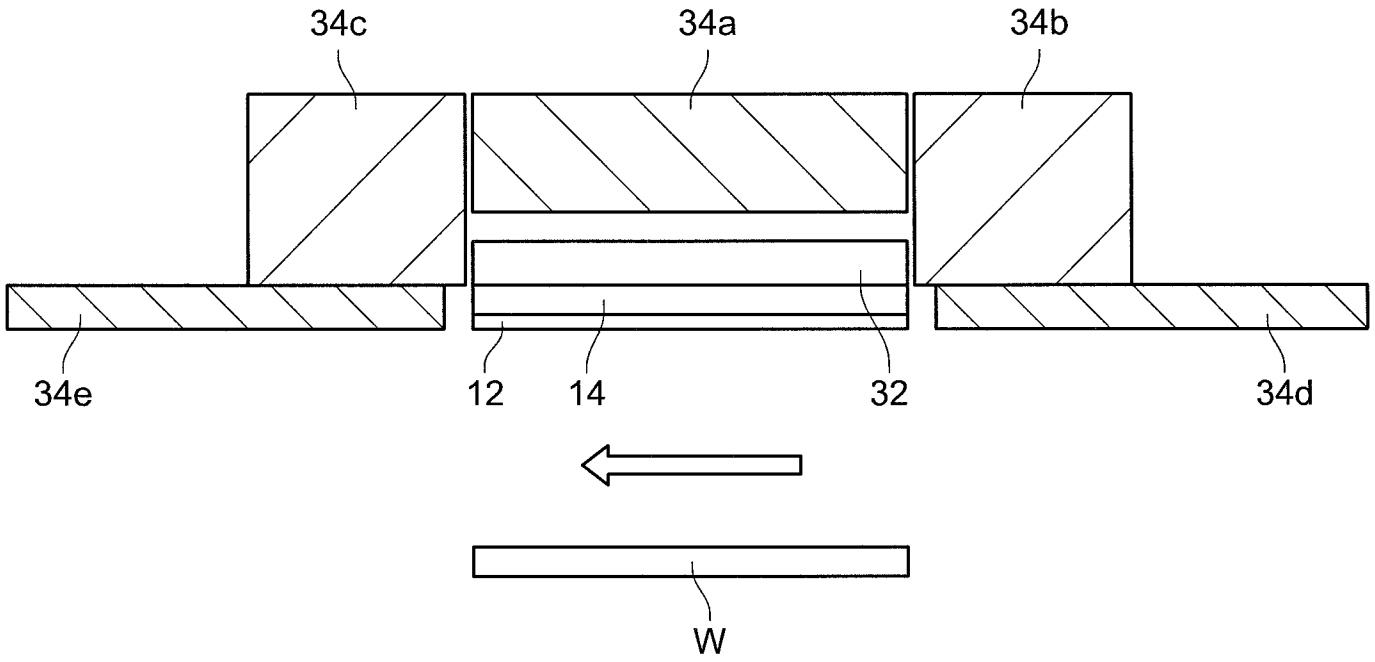
FIG. 4 is a diagram for explaining an example of a heat balance of a heat radiation device according to a comparative example.

As it is apparent from the heat balance calculations in FIGS. 3 and 4 as aforementioned, the heat radiation device 10 of the present embodiment (FIG. 3) suppresses the heat loss from the rear-surface metal layer 20 at a lower degree, and the workpiece W can be heated efficiently with less electric energy. On the other hand, in the heat radiation device of the comparative example (FIG. 4), it has been found that the heat loss is still large despite the arrangement of the insulation members 34*a* to 34*c* as based on a conventional general concept, and the electric energy is required at a greater quantity.

Figure 5:
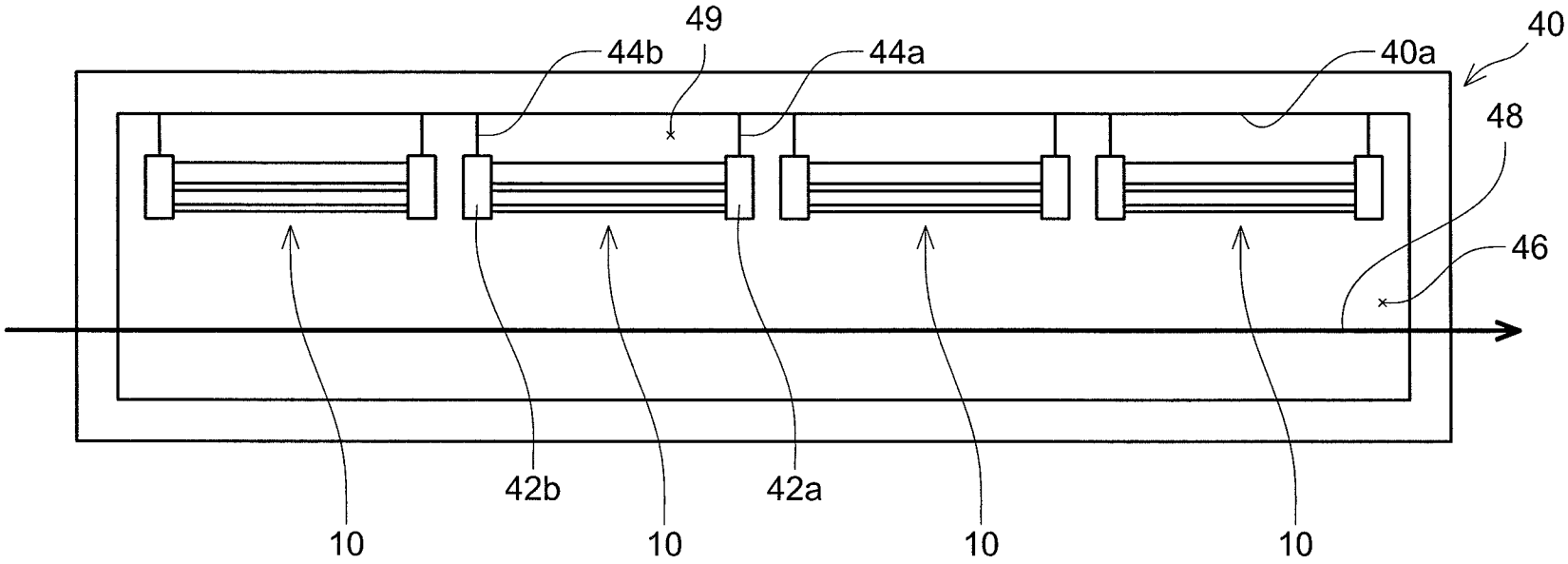
FIG. 5 is a cross-sectional view schematically showing a structure of a processing device using the heat radiation device of the present embodiment.

Next, an example of a processing device configured to process a workpiece using the heat radiation device 10 of the present embodiment will be described with reference to FIG. 5. The processing device shown in FIG. 5 includes a furnace body 40 (which is an example of a housing) and a plurality of heat radiation devices 10 housed in a space 46 in the furnace body 40. The plurality of heat radiation devices 10 is arranged with an interval between each other in a transport direction of the workpiece W. Each of the heat radiation devices 10 is arranged so that the MIM structure layer thereof faces downward. Thus, the rear-surface metal layer 20 of each heat radiation device 10 faces an inner wall surface 40*a* of the furnace body 40. The inner wall surface 40*a* may be constituted of materials with a high reflectivity, such as SUS.

Each of the plurality of heat radiation devices 10 is held on the inner wall surface 40*a* of the furnace body 40 using holder members 44*a*, 44*b* (which are examples of a holder). Specifically, Casings 42*a*, 42*b* are attached to both left and right ends of each heat radiation device 10. The casings 42*a*, 42*b* are in contact with the heat radiation device 10 only at the ends of the heat radiation device 10. An upper end of the holder member 44*a* is fixed to the inner wall surface 40*a*, and a lower end of the holder member 44*a* is fixed to the casing 42*a*. Similarly, an upper end of the holder member 44*b* is fixed to the inner wall surface 40*a*, and a lower end of the holder member 44*b* is fixed to the casing 42*b*. Due to this, the heat radiation device 10 is thereby held on the inner wall surface 40*a* of the furnace body 40. As it is apparent from FIG. 5, the rear-surface metal layers 20 of the heat radiation devices 10 do not directly contact the inner wall surface 40*a*, and spaces 49 are provided therebetween.

To heat the workpiece W in the above processing device, the workpiece W is transported in the furnace body 40 along an arrow 48. The workpiece W transported in the furnace body 40 is radiated with the radiant energy in the specific wavelength range from each of the plurality of heat radiation device 10. Further, the workpiece W is heated by heat transfer caused by the convection of the air flowing in the furnace. Here, the heat radiation devices 10 are connected to the furnace body 40 only at their ends via the casings 42*a*, 42*b* and the holder members 44*a*, 44*b*. Due to this, the heat loss caused by heat transfer from the heat radiation devices 10 to the furnace body 40 can effectively be suppressed. Further, the rear-surface metal layers 20 of the heat radiation devices 10 and the inner wall surface 40*a* of the furnace body 40 face each other with the spaces 49 in between them, so the heat loss by radiation from the rear-surface metal layers 20 is generated. However, since the emissivity of the rear-surface metal layers 20 is set low, the heat loss by the radiation from the rear-surface metal layers 20 to the inner wall surface 40*a* can be suppressed low. Due to this, the processing device shown in FIG. 5 can efficiently radiate the radiant energy in the specific wavelength range onto the workpiece W.

When only the radiant energy in the specific wavelength range is radiated onto the workpiece W, only substances which absorb the radiant energy in the specific wavelength range can be heated while suppressing a temperature of the workpiece W low. For example, when a workpiece W containing a flammable solvent (such as N-methyl-pyrrolidone, methyl isobutyl ketone, butyl acetate, and toluene) (such as a substrate including a coated layer (the solvent being contained in the coated layer)) is to be subjected to a drying process, only the solvent can be evaporated while suppressing the temperature of the workpiece W low by radiating only the radiant energy in the wavelength range which the solvent absorbs onto the workpiece W, and the workpiece W can thereby be dried. Since the solvent can be dried efficiently, the drying process can be performed with less power consumption and in a short period of time.

Figure 6:
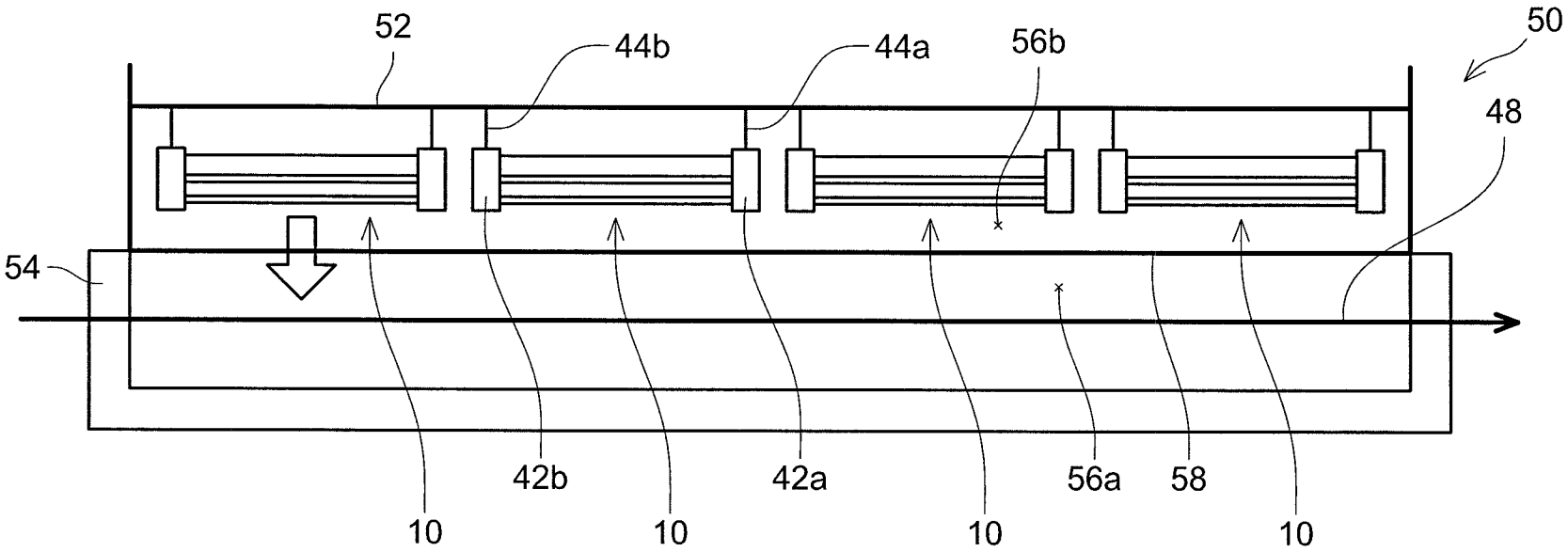
FIG. 6 is a cross-sectional view schematically showing a structure of another processing device using the heat radiation device of the present embodiment.

Further, the heat radiation device 10 of the present embodiment can be used in a processing device shown in FIG. 6. In the processing device shown in FIG. 6, unlike the processing device shown in FIG. 5, it differs greatly in that a space in a furnace body 50 is partitioned by a muffle plate 58 (which is an example of a partition plate), and a space 56*b* housing the heat radiation device 10 and a space 56*a* in which the workpiece W is transported. Specifically, as shown in FIG. 6, the furnace body 50 includes a main body 54 including the space 56*a* where the workpiece W is transported and a support beam 52 provided above the main body 54. An opening at an upper end of the main body 54 is closed by the muffle plate 58. The muffle plate 58 is constituted of a material through which the radiant energy in the specific wavelength range radiated from the heat radiation devices 10 passes. The support beam 52 holds a plurality of heat radiation devices 10. A holding structure that holds the heat radiation devices 10 on the support beam 52 is identical to a holding structure in the processing device shown in FIG. 5.

In the processing device shown in FIG. 6 as well, the radiant energy in the specific wavelength range radiated from the respective heat radiation devices 10 passes through the muffle plate 58 and is radiated onto the workpiece W. Due to this, heating of the workpiece W is implemented. Further, since the muffle plate 58 is provided between the heat radiation devices 10 and the workpiece W, heat energy other than the radiant energy radiated from the heat radiation devices 10 can further be suppressed from being transferred to the workpiece W. As a result, as compared to the processing device shown in FIG. 5, an increase in the temperature of the workpiece W can further be suppressed.

As it is apparent from the foregoing descriptions, the heat radiation devices 10 of the present embodiments can effectively suppress the heat loss from the rear-surface metal layers 20, so a greater quantity of the radiant energy in the specific wavelength range can be outputted with less electric energy. Due to this, the heating process of the workpiece W (such as the drying process of the solvent) can be performed with less energy in a short period of time.

Specific examples of the present invention are described above in detail, but these examples are merely illustrative and place no limitation on the scope of the patent claims. The technology described in the patent claims also encompasses various changes and modifications to the specific examples described above. Further, the technical elements explained in the present description or drawings exert technical utility independently or in combination of some of them, and the combination is not limited to one described in the claims as filed. Moreover, the technology exemplified in the present description or drawings achieves a plurality of objects at the same time, and has technical utility by achieving one of such objects.

The invention claimed is:

1. A heat radiation device configured to radiate radiant energy in a specific wavelength range, the heat radiation device comprising:

a laminated structure in which a plurality of layers is laminated, wherein the laminated structure comprises;

a heat source;

a meta-material structure layer arranged on a front surface side of the heat source and configured to radiate the radiant energy in the specific wavelength range by converting heat energy inputted from the heat source into the radiant energy in the specific wavelength range; and a rear-surface metal layer arranged on a rear surface side of the heat source wherein an average emissivity of the rear-surface metal layer is smaller than an average emissivity of the meta-material structure layer.

2. The heat radiation device as in claim 1, wherein the laminated structure further comprises:

a first support substrate; and a second support substrate, wherein the meta-material structure layer is arranged on a front surface of the first support substrate, the rear-surface metal layer is arranged on a rear surface of the second support substrate, the heat source is arranged between the first support substrate and the second support substrate, and a heat conductivity of the second support substrate is smaller than a heat conductivity of the first support substrate.

3. The heat radiation device as in claim 2, wherein the first support substrate is an AlN substrate, the second support substrate is an $Al_2O_3$ substrate, and the rear-surface metal layer is an Au layer.

4. The heat radiation device as in claim 2, wherein a thickness of the first support substrate is smaller than a thickness of the second support substrate.

5. A processing device configured to process a target object, the processing device comprising:

the heat radiation device as in claim 1 arranged to face the target object;

a housing that houses the target object and the heat radiation device; and a holder that holds the heat radiation device in the housing, one end of the holder attached to an inner wall surface of the housing, and another end of the holder attached to a part of the heat radiation device, wherein the meta-material structure layer of the heat radiation device faces the target object, the rear-surface metal layer of the heat radiation device faces the inner wall surface of the housing, and a gap is provided between the rear-surface metal layer and the inner wall surface of the housing.

6. The processing device as in claim 5, further comprising:

a partition wall partitioning a space in the housing into a first space in which the target object is housed and a second space in which the heat radiation device is housed, wherein the partition wall allows the radiant energy of the specific wavelength range to pass therethrough.

7. The processing device as in claim 5, wherein a drying process is executed to the target object in the housing.

* * * * *